United States Patent [19]

Albert

[11] Patent Number: 4,474,019

[45] Date of Patent: Oct. 2, 1984

[54] METHOD OF RECIRCULATING OIL IN REFRIGERATING SYSTEMS

[75] Inventor: Ludwig Albert, Norrkoping, Sweden

[73] Assignee: Stal Refrigeration AB, Norrkoping, Sweden

[21] Appl. No.: 449,785

[22] Filed: Dec. 14, 1982

[30] Foreign Application Priority Data

Dec. 18, 1981 [SE] Sweden ..... 8107601

[51] Int. Cl.[3] ..... F25B 43/02

[52] U.S. Cl. ..... 62/84; 62/113

[58] Field of Search ..... 62/84, 113, 468, 473, 62/513

[56] References Cited

U.S. PATENT DOCUMENTS

| | | | |
|---|---|---|---|
| 2,709,340 | 5/1955 | Webster | 62/473 |
| 3,021,689 | 2/1962 | Miller | 62/84 |
| 3,543,880 | 12/1980 | Scott | 62/468 |
| 4,275,570 | 6/1981 | Szymasek et al. | 62/468 |

FOREIGN PATENT DOCUMENTS 198732 10/1965 Sweden .

*Primary Examiner*—Ronald C. Capossela
*Attorney, Agent, or Firm*—Cyrus S. Hapgood

[57] ABSTRACT

In the operation of a refrigeration system comprising a compressor, a condensor, an expansion valve and an evaporator which form a circulation circuit containing $NH_3$ refrigerant as a first medium, the compressor being lubricated by a second medium, oil, part of the oil quantity being continuously discharged from the compressor together with compressed $NH_3$-gas into the circulation circuit for recirculation of oil to the compressor, continuously or batchwise, from the low pressure region of the circulation circuit, that is, the region located between the expansion valve and the compressor, the part of the oil transferred to the low pressure region (5, 6, 8, 9, 10, 11) of the circulation circuit is contacted with a third medium, added to the circulation circuit and which is substantially insoluble in liquid $NH_3$, to form a liquid phase which is relatively free-flowing at the temperature prevailing in the low pressure region of the circulation circuit, whereupon said liquid phase, possibly after separation from any excess third medium, is fed to the compressor (1).

5 Claims, 1 Drawing Figure

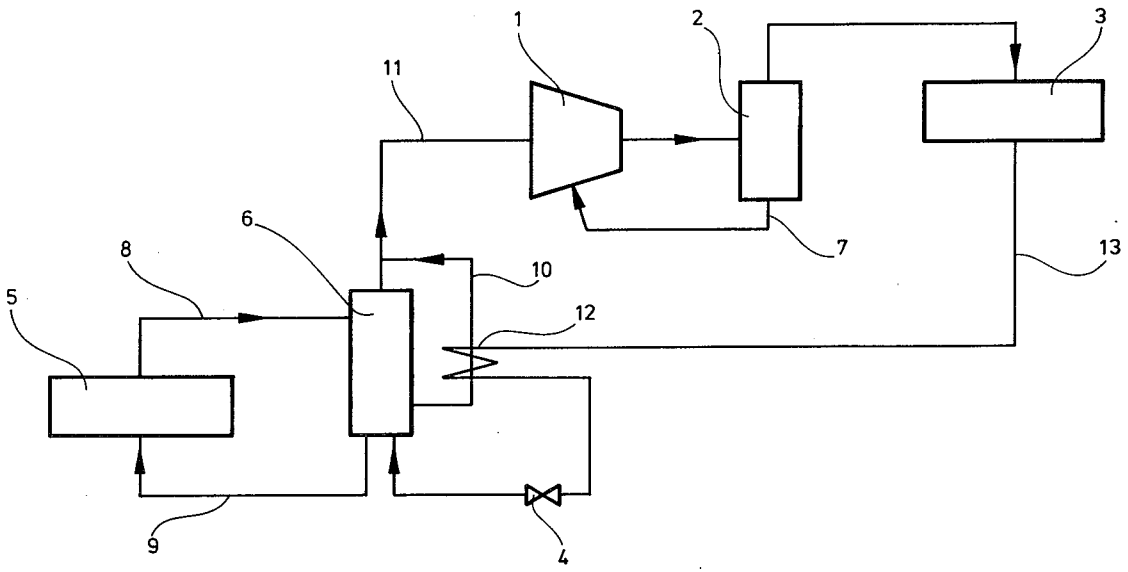
1
2
3
4
5
6
7
8
9
10
11
12
13

METHOD OF RECIRCULATING OIL IN REFRIGERATING SYSTEMS

The present invention relates to a method for operating a system comprising a compressor, a condenser, and expansion valve and an evaporator, which form a circulation circuit containing $NH_3$ as a refrigerant or first medium, the compressor being lubricated by a second medium, oil, part of which is continuously discharged from the compressor together with compressed $NH_3$-gas into the circulation circuit, for recirculation of oil to the compressor, continuously or batchwise, from the low pressure region of the circulation circuit, that is, the region of same which is located between the expansion valve and the compressor.

In refrigeration systems with an oil-lubricated compressor, a certain amount of oil will accompany the refrigerant, in the present case $NH_3$, when the refrigerant in the form of a gas with relatively high pressure and temperature leaves the compressor and enters said circulation circuit. In order to recirculate this amount of oil to the compressor, there is provided an oil separator where most of the transferred oil amount is separated and is then recirculated to the compressor. Minor quantities of oil, however, will always pass through the oil separator and be transferred through the condenser and the expansion valve with the refrigerant to the low pressure region of the circulation circuit. There is usually provided a liquid separator connected to the evaporator and which serves to separate liquid from gas in the flow of refrigerant discharged from the evaporator to the compressor. In this liquid separator, where the refrigerant reaches its lowest temperature in the circulation circuit, oil is accumulated. In plants with $NH_3$, this oil cannot be recirculated according to usual methods, because the viscosity of the oil is too high at the prevailing temperature. The relationship between the oil viscosity and the temperature is such that commercial lubricating oils can scarcely flow at −45° C., which is common temperature in this part of the circulation circuit in a refrigeration system working with $NH_3$. The viscosity of the oil is far above the maximum value which is considered possible for recirculation. Accordingly, the oil is recirculated continuously by dispersing it in the refrigerant, whereby the oil forms small droplets (an aerosol) which are sucked with the refrigerant in the form of a gas to the compressor.

In the Swedish patent specification No. 198,732 there is disclosed means at an evaporator with a liquid separator for recirculation of oil which is dispersed in liquid form in the refrigerant in this part of a refrigeration system. The means consists of a heat exchanger heated by relatively warm refrigerant liquid coming from the condenser, a partial flow of refrigerant with dispersed oil being passed through the heat exchanger and thereby heated so that the refrigerant is transformed into gas form and carries the oil in the form of small droplets or an aerosol to the gas inlet of the compressor. Oil can also be drained and recirculated batchwise to the compressor, if it is of the piston type, to its crankcase.

In addition to the drawback that the oil in $NH_3$-systems does not permit recirculation because of too high viscosity, the oil has a disadvantageous influence on the heat transfer in the evaporator. That is, it coats the heat transferring surfaces and thus partly deteriorates the heat transfer and partly smoothes the surface coarseness, so that the heat transfer by boiling of the refrigerant is impaired.

Thus, there is a demand for a simple, operationally safe method for recirculation of oil in refrigeration systems of the type previously defined.

Such a method is characterized, according to the invention, in that the amount of oil transferred to the low pressure region of the circulation circuit is made to form a liquid phase with a third medium added to the circulation circuit and which is substantially non-soluble in liquid $NH_3$, this liquid phase being relatively free-flowing at the temperature prevailing in the low pressure region of the circulation circuit. Thereupon, said liquid phase, possibly after separation from the third medium, is fed to the compressor in a known manner.

In one suitable embodiment of the invention, the oil is made to form a liquid phase with a third medium in the form of a relatively low-boiling hydrocarbon or a mixture of such. Examples of such hydrocarbons are propane, n-butane and isobutane.

The method according to the invention will now be described in more detail, reference being made to the accompanying drawing wherein the single illustration is a schematic view of a refrigeration system where the method is performed.

The refrigeration system as shown comprises a compressor 1, an oil separator 2, a condenser 3, an expansion valve 4, and an evaporator 5 with a liquid separator 6. A line 7 recirculates oil from the oil separator 2 to the compressor 1. The evaporator 5 is connected to the liquid separator 6 by lines 8 and 9 so that a circulation circuit comprising the evaporator 5 and the liquid separator 6 is formed. From this circulation circuit an oil recirculator extends in the form of a line 10, which is connected to a line 11 leading from the liquid separator 6 to the compressor 1. The line 10 passes through a heat exchanger 12 which is heated by a flow in line 13 through which relatively warm refrigerant passes from condenser 3 to the expansion valve. $NH_3$ is used as refrigerant. The compressor is lubricated by oil. A minor amount of a relatively low-boiling hydrocarbon has been added as a third medium.

In the operation of the system, compressed $NH_3$ leaves the compressor 1 accompanied by ejected oil. The latter is substantially separated in the oil separator 2 and is recirculated through line 7 to the compressor. A minor amount of oil, however, accompanies the ammonia to the condensers and travels further through the expansion valve 4 to the circulation circuit containing the evaporator 5 and the liquid separator 6. Here the hydrocarbon and the oil form a separate, relatively free-flowing liquid phase which is held dispersed in the liquid ammonia. A minor part of same is passed through the heat exchanger 12, where it is heated to evaporation of the ammonia by relatively warm ammonia coming from the condenser 3. The dispersed oil is then transferred with gaseous ammonia to the low pressure side of the compressor through the line 11.

As an example of practicing the method, a system of the type shown in the drawing was filled with 2 tons of ammonia. 120 kgs mineral oil were added for lubrication of the compressor, which was of the screw type. Furthermore, 30 kgs of commercial butane were added.

During continuous operation, the compressed ammonia contains about 100 ppm oil, which are discharged continuously from the compressor. The same amount of oil must be recirculated via the suction line. This is achieved by the aid of the oil recirculator 10, 12, through which passes about 1% of the gas that is to be compressed by the compressor 1. This means that the oil concentration in the ammonia within the low pressure region of the system is 10,000 ppm, corresponding to 20 kgs of oil. The rest of the oil is present in the compressor aggregate, mainly in the oil separator 2 where the temperature is about 85° C. Common gas pressures are about 10 to 13 bars, which corresponds to condensing temperatures of 25° to 35° C.

Experience shows that independent of the very low partial pressure of the butane in the oil separator 2, the butane concentration in the oil is 3°-5°, which in the example corresponds to about 4 kgs. This contamination does not influence the lubricating properties of the oil adversely and is fully acceptable.

The rest of the butane, or 26 kgs, is present within the low pressure region of the system where it forms a solution with the oil, about 20 kgs which are present there. This solution thus contains more than 50% butane. The viscosity of the solution is even at −45° C. lower than 10 cSt. The density of the solution is somewhat higher than that of liquid ammonia, which means that the solution will accumulate mainly in the lower part of the liquid separator 6, from where it can be recirculated with the aid of the oil recirculator 10, 12 to the suction line and be conveyed back to the compressor.

The suction gas, like the pressure gas, contains 100 ppm oil and more than 100 ppm butane. The amounts of oil and butane in the lines 11 and 13 and in the condenser 3 can be completely neglected regarding the content within the oil separator 2, the liquid separator 6 and the evaporator 5. The partial pressure of the suction gas can reach a maximum limit determined by the capacity of the oil recirculator and the butane concentration in the liquid ammonia, which corresponds to 1% of 13,000 ppm or 130 ppm. The oil accompanying the suction gas will join the rest of the oil used for lubrication of the compressor. In spite of the fact that the incoming oil contains more than 50% butane, no rise of the butane concentration will occur in the oil separator but all butane is driven out from the oil in the oil separator, where the concentration is in said region of 3 to 5%.

In the example shown, only one compressor is used. Refrigeration systems for low temperatures, however, are often designed as two- or three-stage systems which compress the refrigerant gas coming from the evaporator or its liquid separator in two or three stages with the aid of two or three compressors. Even in plants of this type the method according to the invention can be used advantageously.

I claim:

1. In the operation of a refrigerating system comprising a compressor, a condenser, an expansion valve and an evaporator connected in a circuit for circulation of an $NH_3$ refrigerant medium, the circuit having a low pressure region located between the expansion valve and the compressor, the compressor being lubricated by oil which is continuously discharged from the compressor together with compressed refrigerant gas, the method which comprises including in said circuit a further medium which is substantially insoluble in liquid $NH_3$, combining said further medium with oil transferred to said low pressure region and thereby forming in said region a liquid phase which is free flowing at the operating temperature in said region, and feeding said liquid phase and $N_3$ from said low pressure region to the compressor.

2. The method of claim 1, which comprises also separating said liquid phase from an excess of said further medium before feeding the liquid phase to the compressor.

3. The method of claim 1, in which said third medium is a low-boiling hydrocarbon.

4. The method of claim 1, in which said third medium is a mixture of low-boiling hydrocarbons.

5. The method of claim 1, in which said third medium is selected from the group consisting of propane, n-butane, isobutane and a mixture thereof.

* * * * *